United States Patent [19]

Steen

[11] 4,163,135

[45] Jul. 31, 1979

[54] HIGH CURRENT SWITCHES USING MULTI-LOUVERED CONTACT STRIPS

[75] Inventor: Donald B. Steen, Bowie, Md.

[73] Assignee: The United States of America as represented by the Secretary of the Navy, Washington, D.C.

[21] Appl. No.: 873,590

[22] Filed: Jan. 30, 1978

[51] Int. Cl.[2] ..... H01H 3/40

[52] U.S. Cl. ..... 200/158; 200/1 V

[58] Field of Search ..... 200/158, 1 V, 16 B, 200/157; 339/178, 179, 268 R, 272 R

[56] References Cited

U.S. PATENT DOCUMENTS

| | | | |
|---|---|---|---|
| 2,564,957 | 8/1951 | Cermak | 200/16 B |
| 2,883,492 | 4/1959 | Landers | 200/16 B |
| 3,246,101 | 4/1966 | Caputi | 200/16 B |
| 3,263,145 | 7/1966 | Dexter | 200/158 |
| 3,567,891 | 3/1971 | Hinkelmann | 200/16 B |
| 3,699,292 | 10/1972 | Ohkita | 200/278 |
| 3,941,957 | 3/1976 | Tilman | 200/252 |

*Primary Examiner*—Herbert F. Ross

*Attorney, Agent, or Firm*—R. S. Sciascia; Q. E. Hodges

[57] ABSTRACT

The invention is a switch for use with very high currents and relatively low voltages. The contacts of the switch comprise several stationary rectangular bus bars positioned parallel to each other and one or more movable bus bars which slide along the surface formed by the stationary bus bars and conduct current from one stationary bus bar to another. Attached to each movable bus bar are several louvered contact strips which establish a large number of electrical contacts between the movable and stationary bus bars and conduct all of the current which flows between them. Electrical circuits through the switch are turned on and off by changing the positions of the movable bus bars. The positions of the movable bus bars are changed using a screw drive mechanism which is driven by an electric motor.

14 Claims, 18 Drawing Figures

FIG. 2
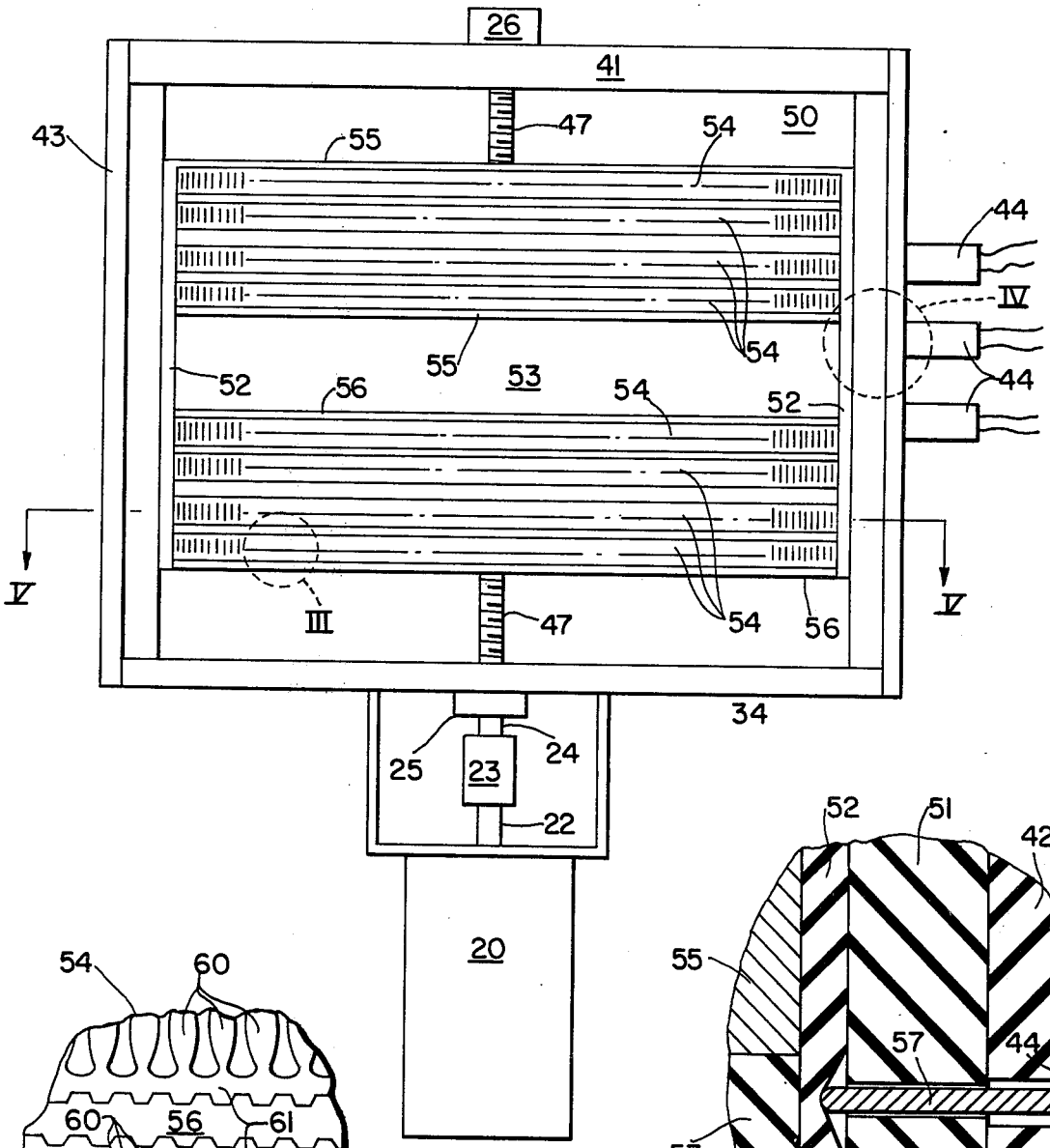
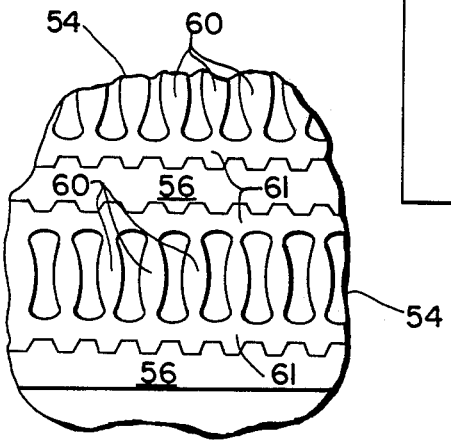
FIG. 3
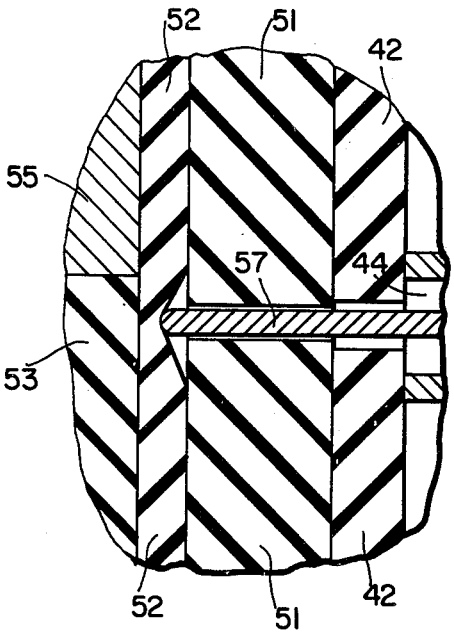
FIG. 4

FIG. 5
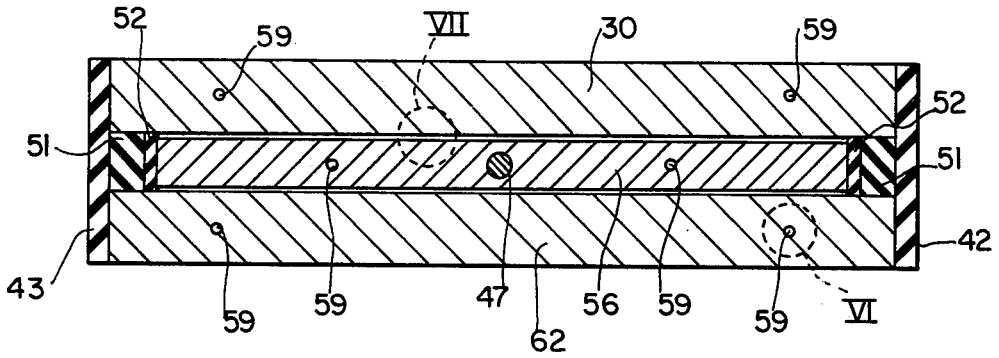
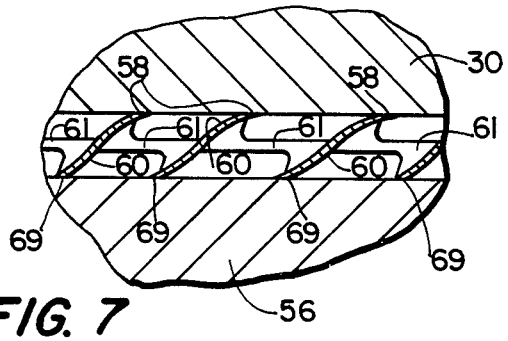
FIG. 7
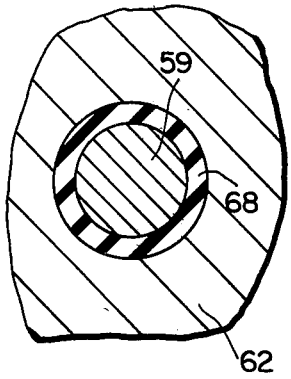
FIG. 6
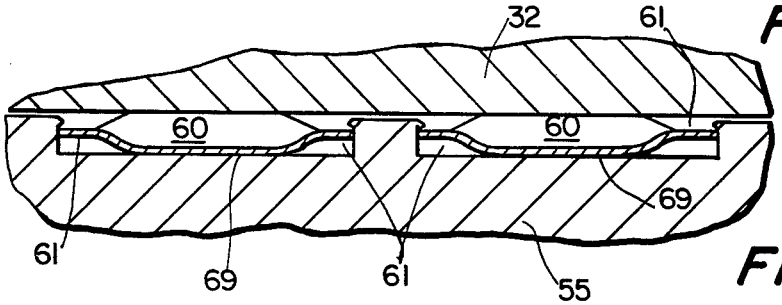
FIG. 9
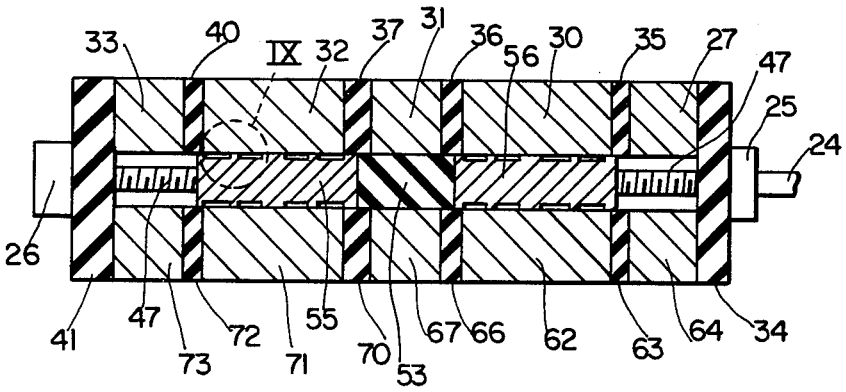
FIG. 8

DPDT SWITCH POSITIONS

FORWARD

OFF

REVERSE

INSULATION COPPER CONDUCTOR ⟶CURRENT FLOW

SPST SWITCH POSITIONS
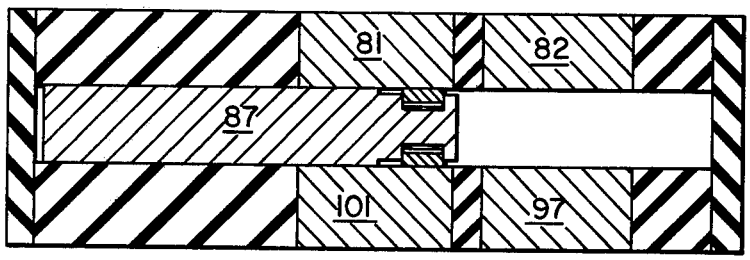
OFF
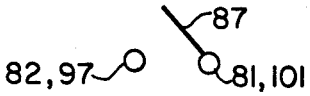
FIG. 15a
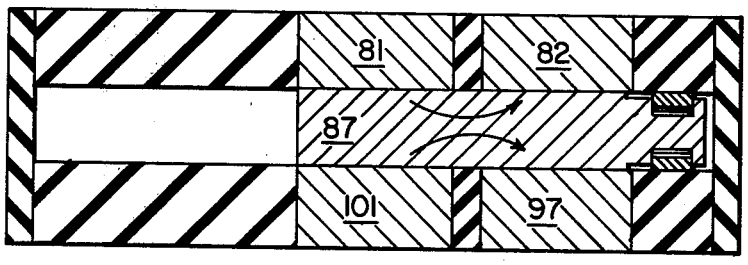
ON
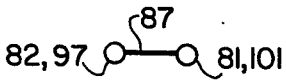
FIG. 15b
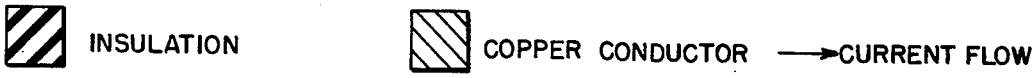

HIGH CURRENT SWITCHES USING MULTI-LOUVERED CONTACT STRIPS

The invention described herein may be manufactured and used by or for the Government of the United States of America for governmental purposes without the payment of any royalties thereon or therefor.

BACKGROUND OF THE INVENTION

This invention is concerned with switches for use in very high current and low voltage applications. These switches were invented for use with voltages from 30 to 300 volts and current from 10,000 to as much as 100,000 amps. In these types of applications it is very important that the internal resistance of the switch be limited to a few micro ohms. If the internal resistance of the switch were not so limited, a significant voltage drop would occur across the switch contacts causing large amounts of power to be dissipated by the switch. The internal resistance of switches is reduced by making the cross sectional area of the internal conductors within the switch as large as possible and by providing as many contacts as is possible between the stationary and the movable switching conductors. In theroy, when flat surfaces on two conductors are pressed together lightly, they will contact each other at a maximum of three points. If the number of points in which they contact is to be increased, then the pressure pushing the two surfaces of the two conductors together must also be increased. The number of contacts between two conductors can also be increased by dividing one of the conductors into a number of flexible sections and applying sufficient force to each of the sections so that each section will be in contact with the other conductor. The current capacity of the conductor will be equal to the sum of the current capacities of each of the flexible sections. Contact strips have recently become available which have multiple louvers for making contact between adjacent conductors. The knife switches, which are shown by the prior art for use in high current applications, apply large forces between the stationary and the movable conductors to increase the number of contacts between them. Switch gear manufacturers have historically produced high current switches by ganging together a sufficient number of low current switches, usually knife switches, to provide the required current capacity. However, as the number of switches which are ganged together is increased, the reliability of the overall switch will decrease. Many of the prior art high current switches also require elaborate water or oil cooling systems to maintain the switches at a proper operating temperature. One other disadvantage of many of the prior art high current switches is the large size and bulkiness of the switches.

OBJECTS OF THE INVENTION

It is therefore an object of this invention to make a high current low voltage switch which is relatively small and compact.

It is another object of this invention to make a high current low voltage switch which is highly reliable in operation.

It is a further object of this invention to make a high current low voltage switch which does not require a water or oil cooling system.

Yet another objective of this invention is to make a high current low voltage switch which has a relatively low internal resistance.

A still further object of this invention is to make a switch which is capable of conducting currents as large as 100,000 amps at voltages up to 300 volts.

SUMMARY OF THE INVENTION

Several heavy copper bus bars are sandwiched together between insulating spacer bars to form a flat surface against which a movable bus bar slides. When the movable bus bar is positioned adjacent to and in contact with portions of two of the stationary bus bars, current will flow from one of the stationary bus bars through the movable bus bar to the other stationary bus bar. One or more movable bus bars are attached together between insulating spacer bars to form a shuttle. The shuttle is moved back and forth across the surface of the stationary bus bars to provide the switching action of opening and closing circuits. A second set of stationary bus bars and spacer bars is formed into a second surface which is mounted on the opposite side of the shuttle from the first surface so that the shuttle is sandwiched between the two sets of the stationary bars. The movable bus bars on the shuttle are covered with multi-louvered contact strips. Each of the contact strips contains a large number of spring like contacts which press against both the stationary and the movable bus bars and conduct electrically between them. The shuttle, which includes the movable bus bars, is moved from one position to another by a rotating screw which is coupled to the shuttle and is turned by an electric motor. The high current capacity for the switch is obtained by using very large bus bars and a large number of contact strips mounted on the movable bus bars. The current density through the bus bars and the contact strips is small enough so that no water or oil cooling system is required to maintain the switch at its proper operating temperature.

BRIEF DESCRIPTION OF THE DRAWINGS

FIG. 2 shows a plan view from the top of the double pole double throw embodiment of this switch with the top layer of bus bars and spacer bars removed.

FIG. 3 shows an enlarged plan view of two of the contact strips on the shuttle of the switch shown in FIG. 2.

FIG. 4 shows a cross sectional view of the manner in which one of the limit switches 44 is mounted on the switch shown in FIG. 2.

FIG. 5 shows a cross sectional view through the double pole double throw embodiment of the switch portrayed in FIGS. 1 and 2.

FIG. 6 shows an enlargement of one portion of the cross sectional view of FIG. 5 to illustrate how the stationary bus bars are held together.

FIG. 7 is an enlargement of one portion of FIG. 5 showing a cross sectional view of how the contact strips fit in between the stationary and movable bus bars.

FIG. 8 shows a cross sectional view of the double pole double throw embodiment of the switch that is shown in FIGS. 1 and 2 with the cross section taken perpendicular to the cross section of FIG. 5.

FIG. 9 is an enlargement of one portion of FIG. 8 showing a cross sectional view of how the contact strips are mounted onto the surface of the movable bus bars.

FIGS. 15*a* and 15*b* are simplified cross sectional view of the single pole single throw embodiment of the switch which illustrate the open circuit and closed circuit positions of the shuttle. Whenever the same feature of the invention is shown in two or more figures, it is labeled with the same reference number.

DESCRIPTION OF THE PREFERRED EMBODIMENT

The drawings illustrate the important details of the single pole single throw and the double pole double throw embodiments of the invention. Other embodiments, such as single pole double throw or double pole single throw can be easily made by combining or deleting various features shown in the two embodiments which are illustrated.

Figure 1:
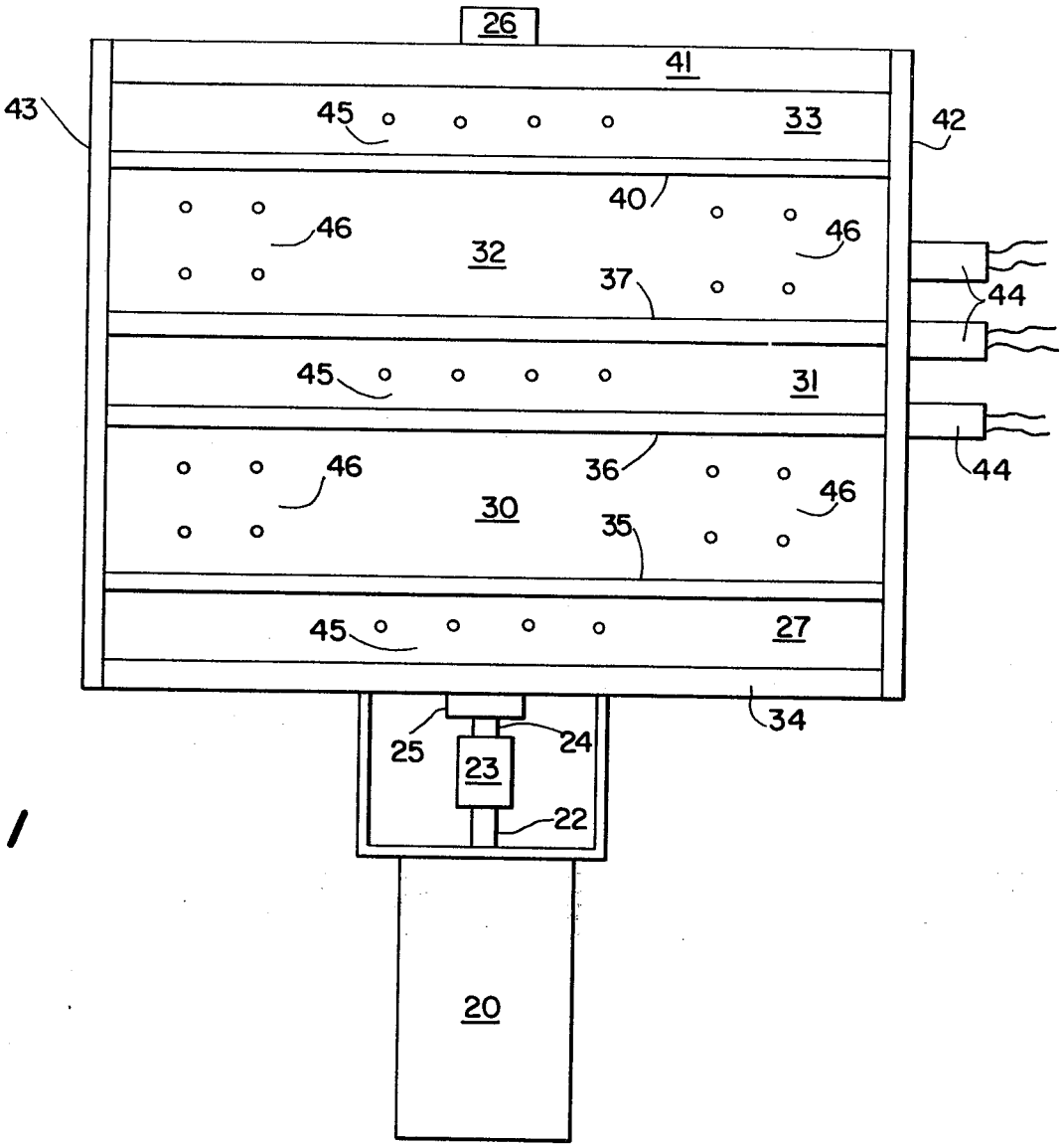
FIG. 1 shows a plan view of the top of the double pole double throw embodiment of the switch.

The double pole double throw embodiment of the switch comprises a movable shuttle which is sandwiched between two layers of stationary bus bars. As shown in FIG. 8, one of the layers includes stationary bus bars 27, 30, 31, 32, and 33. The other layer includes stationary bus bars 64, 62, 67, 71 and 73. The bus bars are separated from each other by insulating spacer bars 35, 36, 37, 40, 63, 66, 70, and 72. The shuttle 50 has two movable bus bars 56 and 55 and one insulating spacer bar 53 between them. The plan view of FIG. 1 shows the top of the first layer of stationary bus bars and insulating spacer bars. In the plan view of FIG. 2 this first layer of bus bars and spacer bars has been removed to show the shuttle.

As shown in FIG. 2, an electric motor 20 is coupled to a drive screw 47 by means of shafts 22 and 24 and coupler 23. The drive screw 47 passes through and is coupled to the shuttle 50. Bearings 25 and 26 hold the drive screw 47 in position. The two end plates 34 and 41 of the switch and the two side plates 42 and 43 are made of insulating material and help to hold the bus bars and spacer bars in position. As is shown in FIG. 5, the stationary bus bars are bolted to each other and the movable bus bars are bolted to the rest of the shuttle by means of threaded rods 59. As is shown in FIG. 6, the threaded rods 59 are insulated from the surrounding bus bars by the insulating tubing 68. Enclosed within the shuttle but not shown in the drawings is the ball bearing screw drive assembly by which the drive screw 47 engages the shuttle. The channel through which the drive screw 47 extends through the shuttle 50 is insulated by another insulating tube so that the drive screw will not make electrical contact with the movable bus bars 55 and 56. As is shown in FIG. 5, the two layers of stationary bus bars are separated from each other by insulating spacer bars 51. The insulating spacer bars maintain the distance between the two layers of stationary bus bars at a constant value so that the shuttle will fit in between them properly. The two insulating side bars 52 on the sides of the shuttle are made of a material such as nylon which will slide easily along the surfaces of the spacer bars 51. The electric motor 20 which turns the drive screw 47 to move the shuttle 50 is controlled by signals which are produced by the position switches 44.

As is shown in the enlarged view of one of the positioned switches in FIG. 4, a probe 57 from the position switch 44 extends through the side plate 42 and the spacer bar 51 into a notch in the shuttle side bar 52. In FIG. 2 the shuttle is shown in its netural position where the probe 57 of the middle position switch fits into the notch of the side bar 52. When the shuttle is in the reverse position and in the forward position probes from the other two position switches will fit into the notch of the side bar 52. When the shuttle is being moved from one of its three positions to another by the motor, the motor will continue to turn until a signal is generated when the probe of one of the position switches slides into the notch of the shuttle side bar 52.

FIGS. 3, 7 and 9 illustrate three views of the contact strips 54. The contact strips are placed on the surface of the shuttle to transmit current between the stationary bus bars and the movable bus bars on the shuttle. As is shown in FIGS. 2 and 8, there are four lengths of contact strip 54 on each side of each of the two movable bus bars for a total of 16 contact strips on the shuttle. FIG. 3 shows an enlarged view of two of the contact strips 54 mounted on the movable bus bar 56. Each of these contact strips has multiple louvers 60 which are held in place and attached to each other by two side strips 61. The shape of each of the louvers 60, as shown in FIG. 7, is compressed somewhat from the shape that these louvers would assume if they were not in contact with the bus bars. Each of the louvers 60 is pressing against the bus bar 30 at points 58 and also pressing against the bus bar 56 at points 69. Current will flow from bus bar 30 through contact points 58, through the louvers 60 and through contact point 69 into the bus bar 56. The total current carrying capacity of the overall contact between any two bus bars in the switch will be equal to the total number of louvers between those two bus bars times the current carrying capacity of each of the louvers. In an embodiment of the switch which was built and tested by the inventor and which was capable of conducting 30,000 amperes, the particular contact strips used were capable of conducting 30 amperes through each of the louvers. Since the 30,000 amps must flow through one set of contact strips to enter the shuttle and another set to leave the shuttle, at least 20,000 of the contact strip louvers were needed in each circuit of the switch to provide a total current carrying capacity of 30,000 amperes. The total amount of compression force which is required between two adjacent bus bars in the switch is equal to the number of louvers times whatever force may be required to cause each of the louvers to make contact with the two bus bars. Since relatively little force is required to cause each individual louver to contact the two adjacent bus bars, the total amount of force required to form a good electrical connection between two adjacent bus bars which have contact strips between them is less than would be required if the two adjacent bus bars did not have the contact strips between them. FIG. 9 illustrates the manner in which the contact strips are mounted on the movable bus bars on the shuttle. Shallow grooves have been machined into the surface of the bus bar 55 and each of the contact strips inserted in the groove. The edges of the grooves are coined to bend in and downward on the edge strips 61 of the contact strips so as to prevent them from coming out of the grooves. Each of the louvers 60 makes contact with the movable bus bar 55 at the bottom of the grooves 69. When the shuttle is moved from one of the switch positions to another, the contact strips will slide along the surface of the stationary bus bars in a direction which would be to the left or right in FIG. 9 and which would be in or out of the figure in FIG. 7. A small amount of lubricant may be placed on the contact strips and the stationary bus bars to reduce the sliding friction which will be encountered when the shuttle is moved.

In a working prototype of a double pole double throw switch which was made by the inventor, a current carrying capacity of 30,000 ampres at 30 volts was achieved with the internal resistance of the switch being less than 3 micro ohms. The movable bus bars and the stationary bus bars were constructed of copper and all of the insulating spacer bars as well as the end plates and side plates were constructed of a glass polyester material which has approximately the same coefficient of thermal expansion as does copper. The bolts, nuts and other hardware which were used to hold all of the bus bars and spacer bars together were constructed of a stainless steel alloy which also has approximately the same coefficient of thermal expansion as the copper bus bars. By thus matching the coefficients of thermal expansion of the various materials used in the switch, the stresses produced by heating within the switch were minimized. Obviously, other materials may be used for the bus bars and spacer bars and for the hardware to hold them together.

The application for which this double pole double throw switch was invented is to reverse the direction of current flow through a homopolar electric motor. Although the switch has a current carrying capacity which is very large, the switch is not able to make or break such large currents because the arcing which would be involved would damage or destroy the contact strips. Whenever the switch is moved from one of its three positions to another, the current flowing through the switch must be temporarily interrupted by some other device.

Figure 10A:
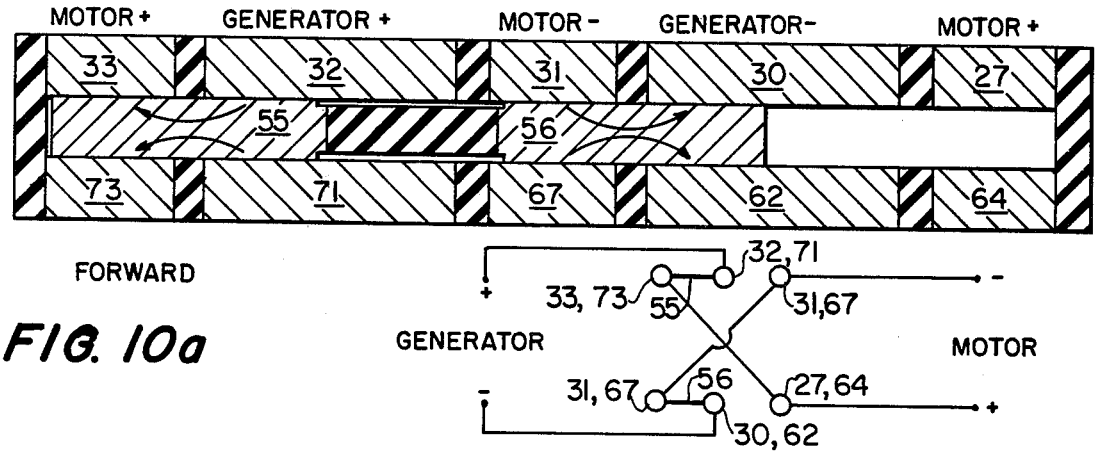
FIGS. 10*a* and 10*b* and 10*c* show simplified cross sectional views of the double pole double throw configuration of the switch to illustrate the three locations that the shuttle would be positioned in for the purpose of reversing the flow of current through a motor.
Figure 10B:
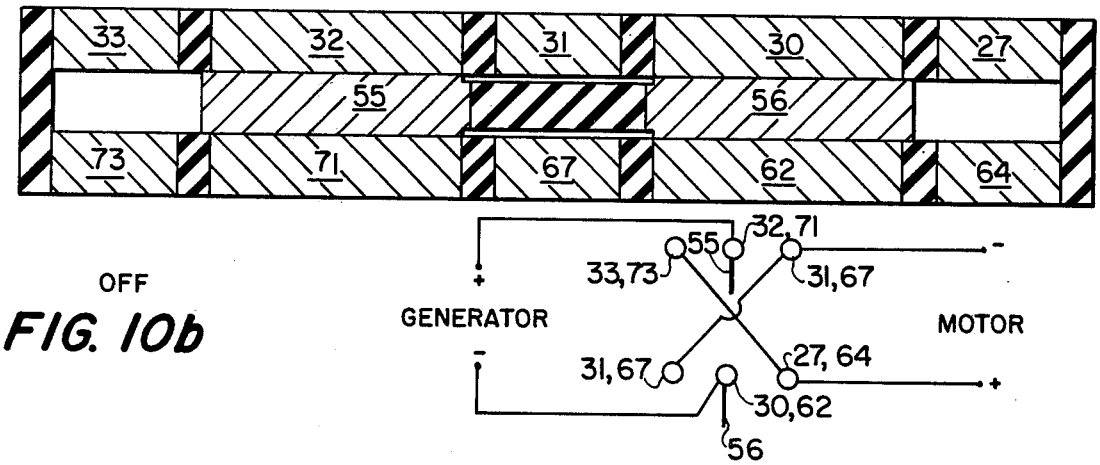
Figure 10C:
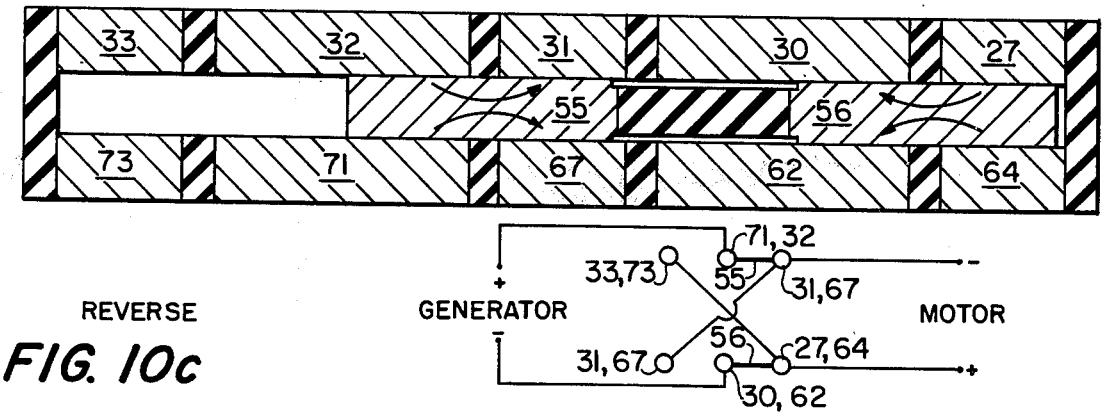

FIGS. 10*a*, 10*b* and 10*c* are simplified cross sectional views of the switch which illustrate the positions assumed by the shuttle while operating as a double pole double throw switch. The circuit diagrams below each of the three figures illustrate how the various bus bars of the switch would be connected together for the purpose of reversing the direction of current flow through a motor. The contact points on the diagrams are labeled with the numbers of the corresponding bus bars in the switch. The stationary bus bars 27, 64, 33, and 73 are connected to the positive terminal of the motor. The stationary bus bars 31 and 76 are connected to the negative terminal of the motor. The bus bars 30 and 62 are connected to the negative terminal of the generator and bus bars 32 and 71 are connected to the positive terminal of the generator. As can be seen from the diagrams, the bus bars which are on opposite sides of the shuttle from each other are connected together. In addition, the two pairs of bus bars at opposite ends of the switch are connected together. The arrows in the movable bus bars on the shuttle indicate the directions of current flow through the shuttle. When the shuttle is in the forward position, current flows from the stationary bus bars 32 and 71 through the movable bus bar 55 to the stationary bus bars 33 and 73. Also current flows from the stationary bus bars 31 and 67 through the movable bus bar 56 to the stationary bus bars 30 and 62. When the shuttle is in the off position as is shown in FIG. 10*b* the movable bus bar 55 is aligned exactly between the two stationary bus bars 32 and 71, and the movable bus bar 56 is aligned exactly between stationary bus bars 30 and 62. No current is flowing between any of the stationary bus bars or through the movable bus bars. When the switch is in the reverse position, current is flowing from stationary bus bars 32 and 71 through the movable bus bar 55 to the stationary bus bars 31 and 67. Current is also flowing from stationary bus bars 27 and 64 through the movable bus bar 56 into the stationary bus bars 30 and 62.

The stationary bus bars 32, 71, 30 and 62 are always in contact with the shuttle and are twice as wide as are the other stationary bus bars, Therefore the current density inside the wide stationary bus bars will be only half as large as the current density inside of the narrower stationary bus bars. The plan view of the top layer of stationary bus bars and spacer bars in FIG. 1 shows the locations of several holes 45 and 46 which are drilled and tapped into the outside surface of these bus bars for the purpose of connecting feeder bus bars to the switch. The holes 45 in the narrower bus bars 33, 31, and 27 in FIG. 1 are located in the center of the bus bars whereas the holes 46 in the wide bus bars 32 and 30 are located at the end of the bus bars. When the current is fed into and out of a bus bar at its center, the average current density through the bus bar will be only half as great as it would be if the current were fed into and out of the bus bar only at one end. For this reason, the wide bus bars have terminal holes placed at the ends and the narrower bus bars always have the terminal holes placed near the center. The terminal holes are placed near both ends of the wide bus bars to provide flexibility in hooking them up to the feeder bus bars. However, normally only one end of each of the wide bus bars 30 and 32 will be connected to a feeder bus bar. By positioning the connection holes 45 and 46 on the stationary bus bars in this manner the current density of each of the stationary bus bars is made to be nearly the same and the heat generated within the bus bars is equalized. The stationary bus bars are connected to the feeder bus bars by mounting a terminal block on the stationary bus bar using the holes 45 and 46 and bolting the feeder bus bar to the terminal block. The quality of the electrical contact between the bus bars and the terminal block is increased by covering the contact surface with a low temperature solder.

Figure 11:
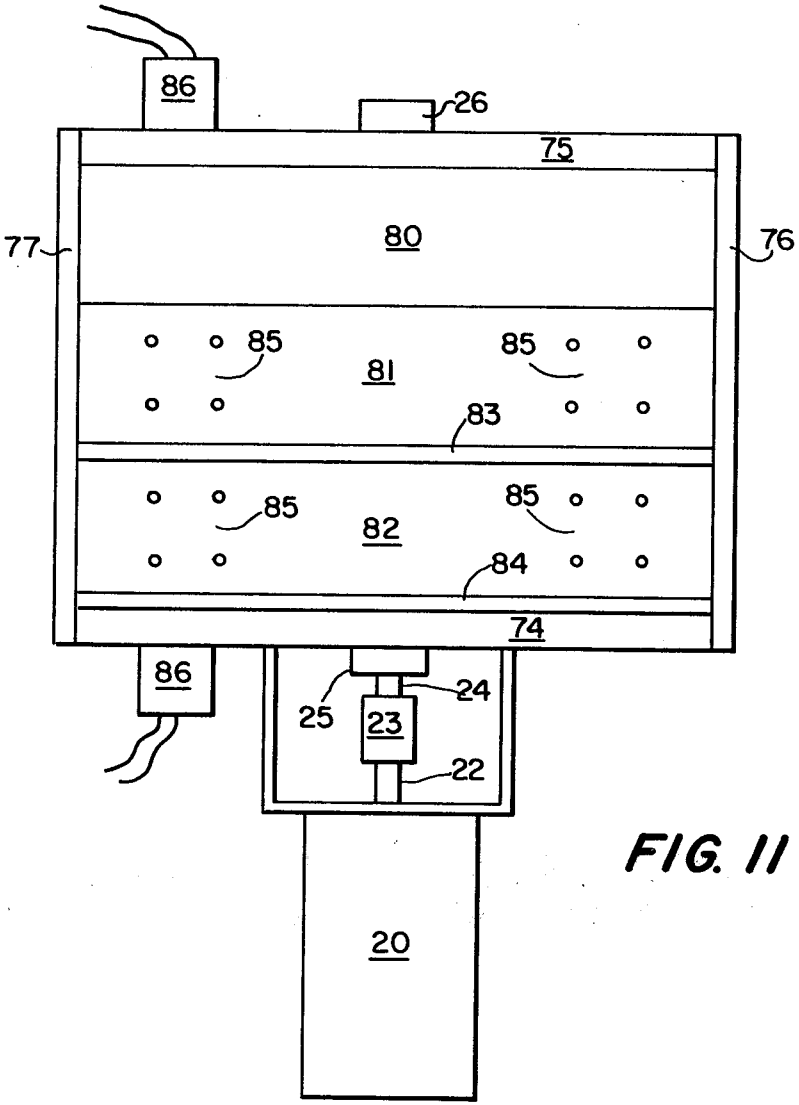
FIG. 11 shows a plan view of the top of the single pole single throw embodiment of the switch.
Figure 12:
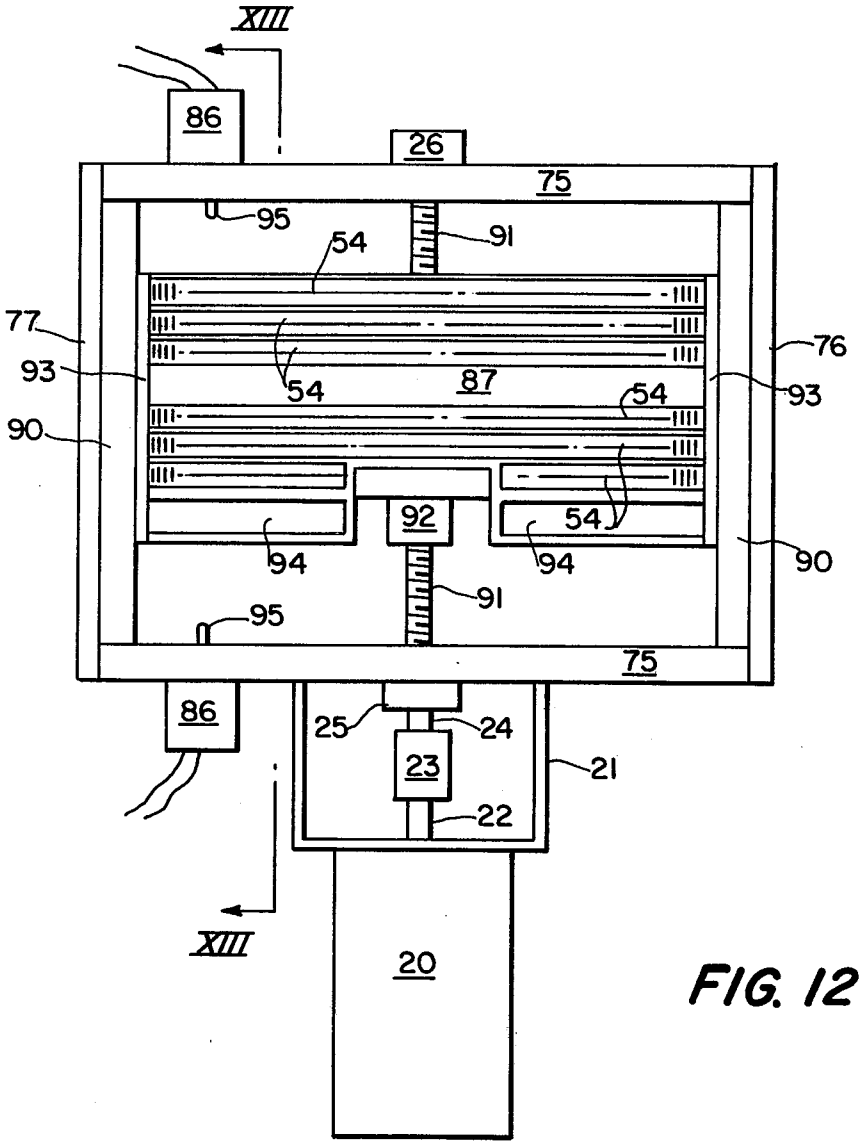
FIG. 12 shows a plan view of the single pole single throw embodiment of the switch that is shown in FIG. 11 with the top layer of bus bars and spacer bars removed.
Figure 13:
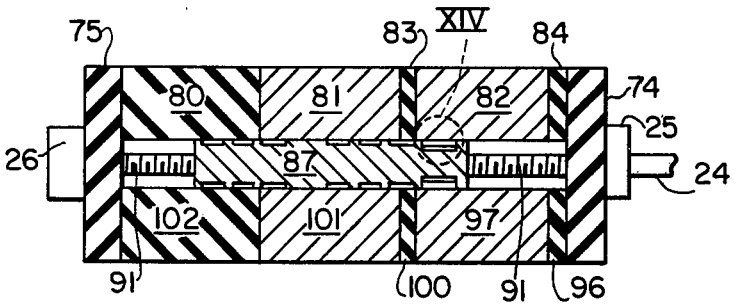
FIG. 13 shows a cross sectional view of the single pole single throw embodiment of the switch which is shown in FIGS. 11 and 12.

FIGS. 11 through 15 illustrate a single pole single throw embodiment of this invention. FIG. 11 is a plan view of the top of the switch and FIG. 12 is a plan view of the switch with the top layer of bus bars and spacer bars removed. FIG. 13 is a cross sectional view of the switch showing how all of the bus bars and spacer bars are positioned relative to each other. There are four stationary bus bars 81, 82, 101, and 97. In this embodiment the shuttle comprises one large movable bus bar 87. The bus bars are separated and surrounded by insulating spacer bars 80, 83, 84, 102, 100 and 96. The top 75 and bottom 74 edges of the switch as well as the two side edges 76 and 77 are also made of insulating material. As in the other embodiment of the switch, the shuttle is moved by a drive screw 91 which engages a ball bearing screw drive assembly 92 attached to the shuttle. The drive screw drive 91 is supported by bearings 26 and 25 and is turned by the electric motor 20 by way of shafts 22 and 24 and coupler 23. The two position switches 86 are installed on the end plates 75 to detect when the shuttle is located at either end of the switch. Each side of the movable bus bar 87 on the shuttle has six rows of contact strips 54 mounted on it. The sides 93 of the shuttle are made of an insulating material such as nylon which will slide easily over the spacer bars 90. The spacer bars 90 hold the bus bars at a proper separation from each other. The holes 85 for mounting the terminal blocks are located only at the ends of the stationary bus bars 81, 82, 97, and 101.

Figure 14:
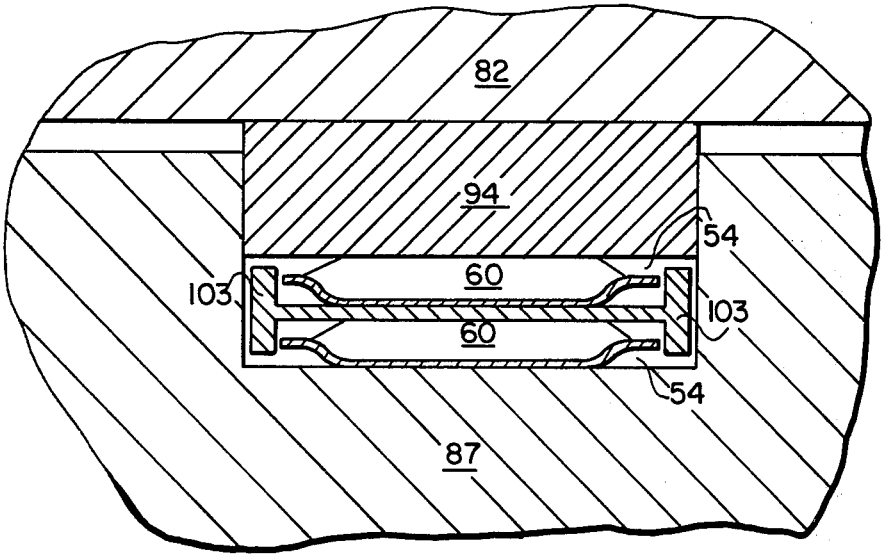
FIG. 14 shows an enlarged view of one portion of FIG. 13 to illustrate the breaker bar which makes and breaks currents when the shuttle position is switched.

Whereas the current through the double pole double throw switch disclosed in FIGS. 1 through 10 had to be reduced to nearly zero before the position of the shuttle could be changed, the shuttle in the single pole single throw switch may be moved while a substantial amount of current is flowing through it. Breaker bars 94 are mounted on the leading edge of the movable bus bar 87 to make the first contact with the stationary bus bars 82 and 97 when the switch is turned on and to make the last contact with them when the switch is turned off. FIG. 14 shows an enlarged cross sectional view of one of the breaker bars. A groove is cut into the movable bus bar 87 and the breaker bar 94 is inserted into this groove and pressed against the stationary bus bar 82 by two layers of contact strips which are inserted into the bottom of the groove. The louvers 60 of each of the two layers of contact strips act like springs to press the breaker bar 94 upward against the stationary bus bar 82 and at the same time to conduct current from breaker bar through to the movable bus bar 87. The material spacer 103 separates and conducts current between the two layers of contact strips. Current will flow from the stationary bus bar 82 through the breaker bar 94 and from the breaker bar 94 either directly to the movable bus bar 87 or through the contact strips 54 and spacer 103 to the movable bus bar 87. The breaker bar 94 is made of the same materials as are the bus bars. The breaker bar 94 is able to withstand much more arcing than can the contact strips and it is located in a position on the movable bus bars 87 so that any arcing which does occur will occur through the breaker bar. Therefore the current flowing through this embodiment of this invention need not be completely interrupted before the switch is turned on or off. It will be sufficient if the current is reduced to some fraction of the full current load before the switch is turned on or off. The particular size of this fraction will be determined by the size of the breaker bar. If breaker bars were installed on both ends of both the movable bus bars 55 and 56 of the double pole double throw embodiment of this invention, then that switch could also be moved from one position to the other without reducing the current through it all the way to zero. The inventor built a prototype of this single pole single throw switch which was capable of conducting 30,000 amps. A large reostat was used to temporaily reduce the current through the switch to about 1,000 amps while the switch was being turned on or off and the breaker bars were able to withstand the arcing of the 1,000 amps. The single pole single throw switch in turn was used to interrupt the flow of current through the double pole double throw switch prototype that is illustrated in FIGS. 1 through 10. FIGS. 15*a* and 15*b* illustrate the two positions of the movable bus bar 87 corresponding to the on and off contitions of the single pole single throw switch. The equivalent circuit diagrams of this switch are shown below the figures with the numbers of the bus bars labeled on the corresponding parts of the diagrams. As shown in the diagrams, the stationary bus bars 81 and 101 are connected together and the stationary bus bars 82 and 97 are connected together. With the shuttle in the position shown in FIG. 15*a*, no current is flowing through the bus bars. With the movable bus bars in the position shown in FIG. 15*b*, current is flowing from bus bars 81 and 101 through the movable bus bar 87 into the stationary bus bars 82 and 97.

In all of the embodiments of the switch shown in the figures, the contact strips were mounted on the movable bus bars. However, the contact strips could be mounted on the stationary bus bars instead without altering the performance of the switch.

In both of the embodiments of the invention described above, the stationary bus bars and the insulating spacer bars are arranged so as to form two parallel plane surfaces which are separated by a distance equal to the thickness of the shuttle. The two surfaces of the shuttle which contact the stationary bus bars are also parallel plane surfaces. It would be possible to build the switches in such a manner that the opposing sets of stationary bus bars do not form plane surfaces which are parallel to each other. The opposing sets of parallel bus bars could form curved surfaces which are therefore not plane surfaces at all. The embodiments of this invention which have been described above show all of the bus bars as being rectangular in shape and as having a substantial length. The shuttle is also shown as being rectangular in shape. The advantage of using the rectangular conductors within the switch and in arranging them so as to form surfaces which are more or less parallel to each other is that the greatest amount of current carrying capacity can be obtained from a small switch in this manner. If the shuttle of a switch with a 30,000 amp current capacity were made to be cylindrical in shape and all of the contacts were placed around the circumference of the cylinder, the switch could not be packaged in such a small volume as was the 30,000 amp prototype switch built by the inventor and illustrated in the figures. The sandwich type of switch construction illustrated in the figures results in the highest possible current carrying capacity for a switch packaged into as a small a volume as possible. The function of the movable bus bars on the shuttle is to transfer the current from one of the stationary bus bars to another and therefore the movable bus bars may also be thought of as transfer plates. The electric motor, the shafts and the drive screw are one illustration of an actuator means which may be used to move the position of the shuttle in the switch. Other actuator means such as hydraulic or pneumantics cylinders, various types of motors, or hand operated levers may also be used.

Obviously many modifications and variations of this invention are possible in light of the above teachings. It is therefore to be understood that within the scope of the appended claims the invention may be practiced otherwise than as specifically described.

What is claimed is:

1. A switch for use in carrying at least 10,000 amperes comprising:

a plurality of stationary metal bus bars insulated from each other;

at least one movable metal bus bar with each of said stationary and movable bus bars having a switching surface which is flat, the switching surfaces of the plurality of the stationary bus bars being positioned so as to lie within a plane surface along which said movable bus bar may be moved to open and close electrical circuits, the flat switching surface of said movable bus bar being positioned facing toward and parallel to said plane surface and in contact with at least one of said stationary bus bars switching surfaces, the movable bus bar being configured so that when it is positioned overlapping portions of two stationary bus bars, current will flow from one stationary bus bar through the movable bus bar to the other stationary bus bar;

a plurality of contact strips making said contact positioned so that said current will flow through the contact strips between the movable bus bar and a stationary bus bar, each of said contact strips having a plurality of spring like contacts which press against the flat switching surfaces of both the movable bus bar and the adjacent stationary bus bars;

actuator means for moving the movable bus bar within said switch so that an electrical circuit may be opened and closed between different stationary bus bars through the contact strips and the movable bus bar.

2. The switch of claim 1 wherein:

the flat switching surfaces on said stationary bus bars and movable bus bar are trapezoidal in shape with two end edges and two side edges, with the two side edges of each switching surface being parallel to each other and longer than the end edges;

all of the bus bars are positioned so that all of their side edges are parallel to each other; and adjacent stationary bus bars are separated by electrically insulating spacer bars.

3. The switch of claim 2 wherein:

said actuator means comprises a rotatable screw which is coupled to said movable bus bar so that the movable bus bar will be moved only perpendicular to the side edges of said switching surfaces;

said contact strips are attached to said movable bus bars.

4. The switch of claim 3 wherein said actuator means further comprises an electric motor and limit switches and wherein said screw is rotated by the electric motor and the motor is controlled by the limit switches which sense the position of said movable bus bar relative to said stationary bus bars.

5. The switch of claim 2 wherein the movable bus bars and the stationary bus bars form a single pole single throw switch.

6. The switch of claim 2 wherein the movable bus bars and the stationary bus bars form a single pole double throw switch.

7. The switch of claim 2 wherein the movable bus bar forms a shuttle which with the stationary bus bars operate as a single throw switch with a plurality of poles.

8. The switch of claim 2 wherein the switch includes a plurality of movable bus bars and wherein the movable and stationary bus bars operate as a double throw switch with a plurality of poles.

9. The switch of claim 4 wherein the movable and stationary bus bars form a single pole single throw switch.

10. The switch of claim 4 wherein the movable and stationary bus bars form a single pole double throw switch.

11. The switch of claim 4 wherein the switch includes a plurality of movable bus bars and wherein the movable and stationary bus bars operate as a single throw switch with a plurality of poles.

12. The switch of claim 14 wherein the switch includes a plurality of movable bus bars and wherein the movable and stationary bus bars operate as a double throw switch with a plurality of poles.

13. A switch for use in a circuit carrying at least 10,000 amperes comprising:

a plurality of stationary metal bus bars insulated from each other;

at least one movable metal bus bar, with each of said stationary and movable bus bars being rectangular and at least four times longer than they are wide, all of the bus bars being positioned parallel to each other, the stationary bus bars being positioned so as to form two parallel plane surfaces between which said movable bus bar is moved to open and close circuits between stationary bus bars, the movable bus bar being configured so that when it is positioned overlapping portions of two stationary bus bars, current will flow from one stationary bus bar through the movable bus bar to the other stationary bus bar;

a plurality of contact strips for carrying said current positioned on both sides of the movable bus bar to lie between the movable bus bar and the stationary bus bars, each of said contact strips having at least ten flexible spring like contacts which press against the surfaces of both the movable bus bar and the adjacent stationary bus bars so that all current passing between the movable bus bars and the stationary bus bars will pass through the contact strips;

actuator means for moving the movable bus bar within said switch perpendicular to the length axis of all the bus bars so that an electrical circuit may be opened and closed between different stationary bus bars through the contact strips and the movable bus bar.

14. The switch of claim 13 wherein:

said actuator means comprises a rotatable screw, an electric motor and limit switches wherein said screw is rotated by the electric motor and the motor is controlled by the limit switches which sense the position of said movable bus bar relative to said stationary bus bars;

said contact strips are attached to said movable bus bars, the total number of contacts on any one movable bus bar being equal to at least twice the current carrying capacity of the switch divided by the current carrying capacity of a single contact.

* * * * *